United States Patent [19]

Novet et al.

[11] Patent Number: 4,951,547

[45] Date of Patent: Aug. 28, 1990

[54] ENDLESS STORAGE AND CONVEYOR CHAIN IN AN AMMUNITION MAGAZINE

[75] Inventors: Hanspeter Novet, Volketswil; Bruno Ruppen, Zürich, both of Switzerland

[73] Assignee: Werkzeugmaschinenfabrik Oerlikon-Bührle AG, Zürich, Switzerland

[21] Appl. No.: 406,280

[22] Filed: Sep. 11, 1989

[30] Foreign Application Priority Data

Sep. 28, 1988 [CH] Switzerland ..... 03610/88

[51] Int. Cl.[5] ..... F41A 9/04

[52] U.S. Cl. ..... 89/34; 198/851

[58] Field of Search ..... 89/33.14, 33.16, 34; 198/851

[56] References Cited

U.S. PATENT DOCUMENTS

| | | | |
|---|---|---|---|
| 1,937,304 | 11/1933 | Worrall | 198/851 |
| 3,512,424 | 5/1970 | Hale | 474/234 |
| 3,596,527 | 8/1971 | Besten | 474/156 |
| 4,252,049 | 2/1981 | Franz et al. | 89/34 |
| 4,573,395 | 3/1986 | Stoner | 89/34 |
| 4,841,837 | 6/1989 | Novet | 89/33.25 |

FOREIGN PATENT DOCUMENTS

| | | | |
|---|---|---|---|
| 513452 | 8/1952 | Belgium | 89/33.16 |
| 0231493 | 8/1987 | European Pat. Off. . | |
| 694391 | 7/1940 | Fed. Rep. of Germany | 198/851 |
| 3644513 | 6/1988 | Fed. Rep. of Germany . | |
| 2168656 | 8/1973 | France . | |

*Primary Examiner*—Stephen C. Bentley

*Attorney, Agent, or Firm*—Werner W. Kleeman

[57] ABSTRACT

During delivery of ammunition to a firing weapon from an ammunition magazine, in which the ammunition is arranged in an endless storage and conveyor chain, high acceleration forces occur, since the entire ammunition supply in the ammunition magazine must be accelerated to the required infeed velocity in the shortest possible time. In order to maintain as small as possible these acceleration forces in the ammunition magazine, the endless storage and conveyor chain is telescopically structured according to the invention, so that not all cartridges in the ammunition magazine have to be simultaneously accelerated.

6 Claims, 2 Drawing Sheets

ENDLESS STORAGE AND CONVEYOR CHAIN IN AN AMMUNITION MAGAZINE

BACKGROUND OF THE INVENTION

The present invention broadly relates to an ammunition conveyor system and pertains, more specifically, to a new and improved construction of an endless storage and conveyor chain in an ammunition magazine.

Generally speaking, the present invention relates to a new and improved construction of an endless storage and conveyor chain in an ammunition magazine, from which the cartridges or rounds are delivered to an automatic firing weapon. The endless storage and conveyor chain comprises a cartridge infeeding device driven by the firing weapon. This cartridge infeeding device is augmented by a booster motor, the endless storage and conveyor chain with the ammunition thereupon forming at least one loop in the ammunition magazine and being guided or trained over at least one drive wheel and at least one deflection roll or roller.

A known ammunition infeed apparatus of this type is disclosed, for example, in German Patent No. 3,644,513, published June 16, 1988. With this ammunition infeed apparatus for linkless ammunition for self-feeding firing weapons, particularly aircraft guns or cannons, the intake or infeed of ammunition from an ammunition container to an automatic firing weapon is augmented by a booster motor. The ammunition container is provided with intermediate floors or bottoms, at which the cartridges are superposed in one or several loops of an endless conveyor chain. This endless conveyor chain is guided or trained over at least one drive wheel and several deflection wheels, deflection shells and buffer wheels. The ammunition is delivered to a transfer unit for feeding and diverting ammunition and/or cartridge cases. Two moveably mounted loop-forming deflection devices are accelerated by means of a biased gas pressure spring in the ammunition buffer.

This known ammunition infeed apparatus has the disadvantage that particular measures and extensive means are required to maintain substantially small the acceleration forces occurring at the beginning of a firing burst or operation. Such measures and means require a corresponding constructional expenditure and increase manufacturing costs.

A further conveyor chain for infeeding cartridges is disclosed, for example, in European Patent Application No. 0,231,493, published Aug. 12, 1987 and the cognate U.S. Pat. No. 4,841,837 granted June 27, 1989. The conveyor chain is a cradle or bucket chain for infeeding cartridges or rounds from an ammunition magazine through a cartridge infeed channel to an automatic firing weapon. The individual cradle elements of the cradle or bucket chain are hingedly interlinked by means of bolts. Each such bolt is mounted in a ball or spherical joint located in an associated lug and extends into elongated holes provided in two lugs of the neighboring cradle element.

This known cradle or bucket chain for infeeding cartridges or rounds from an ammunition magazine through a cartridge infeed channel to an automatic firing weapon is not suitable as a storage and conveyor chain in an ammunition magazine from which the cartridges are delivered to an automatic firing weapon, the ammunition magazine having a special cartridge infeeding conveyor which is driven by the automatic firing weapon.

The known cradle or bucket chain is actually constructed to easily traverse through the cartridge infeed channel even if the latter is extensively curved.

A conveyor chain is described, for example, in U.S. Pat. No. 3,512,424, granted May 19, 1970. The pintle chain of the flat-link type comprises individual U-shaped members. The closed end of such a U-shaped member extends into the open end of the neighboring U-shaped member. A pintle consists of a pin and a bushing press fitted thereon, the bushing forming the center section and the pin ends, which project from the bushing, forming the end portions of the pintle. U-shaped members are placed in registering relationship, with the slots of a first member in axial alignment with the holes of an adjacent U-shaped member. The pin ends extending through the slots and holes are upset or peened to form a riveted connection. The slots and the pin ends therein cooperatively provide for relative longitudinal movement of the links of the chain.

This known chain is neither a storage and conveyor chain in an ammunition magazine nor a bucket chain between an ammunition magazine and an automatic firing weapon.

SUMMARY OF THE INVENTION

Therefore, with the foregoing in mind, it is a primary object of the present invention to provide a new and improved construction of an endless storage and conveyor chain in an ammunition magazine from which cartridges or rounds are delivered to an automatic firing weapon, which endless storage and conveyor chain does not exhibit the aforementioned drawbacks and shortcomings of the prior art constructions.

Another and more specific object of the present invention aims at providing a new and improved construction of an endless storage and conveyor chain in an ammunition magazine, which with simple auxiliary or supplementary means is capable of absorbing the acceleration forces occurring at the beginning of a firing burst or operation.

Yet a further significant object of the present invention aims at providing a new and improved endless storage and conveyor chain which is substantially simpler in construction and design than prior art conveyor chains of this type, relatively economical to manufacture, highly reliable in operation, not readily subject to breakdown or malfunction and requires a minimum of maintenance.

Now to implement these and still further objects of the present invention, which will become more readily apparent as the description proceeds, the endless storage and conveyor chain of the present invention is manifested, among other things, by the features that the at least one loop of the endless storage and conveyor chain is folded to form a double loop having a substantially central portion which is driven by the booster motor by means of the at least one drive wheel. Furthermore, the endless storage and conveyor chain is telescopically structured for absorbing acceleration forces which occur at the beginning of a firing burst or operation as well as in the case of firing a single round.

Preferably, the individual chain elements or members are fastened together with an appropriate or predetermined clearance such that at least one cartridge or round can be fired until the entire endless storage and conveyor chain is accelerated to the required infeeding velocity. Furthermore, this endless storage and conveyor chain preferably comprises chain elements or members in the region of the cartridge tip ends as well as in the region of the cartridge bottom ends, such chain elements or members being appropriately fastened together by cradles or buckets which serve to accommodate or receive individual cartridges or rounds.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
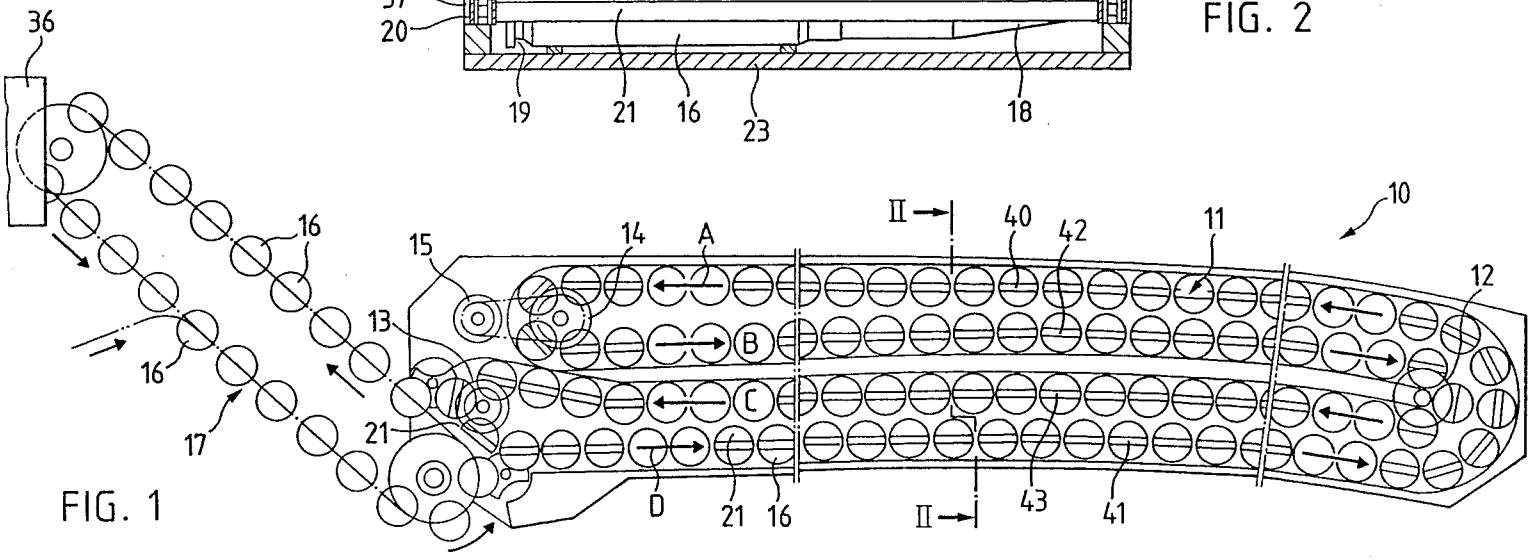
FIG. 1 shows a schematic illustration of an ammunition magazine containing the endless storage and conveyor chain constructed according to the invention.

Describing now the drawings, it is to be understood that in order to simplify the illustration thereof, only enough of the construction of the exemplary embodiment of the endless storage and conveyor chain in an ammunition magazine has been shown therein as is needed to enable one skilled in the art to readily understand the underlying principles and concepts of the present invention. Turning attention now to FIG. 1 of the drawings, an ammunition magazine 10 illustrated therein by way of example and not limitation will be seen to be structured such that it can be accommodated as an airborne ammunition magazine in the wing of an aircraft. In this ammunition magazine 10 there is located an endless storage and conveyor chain 11 which is folded into a double loop. This endless storage and conveyor chain 11 is trained, on the one side, over a single deflection roll or roller 12 and, on the other side, over a lower deflection roll or roller 13 and an upper deflection roll or roller 14. This upper deflection roll or roller 14 is driven by a suitable auxiliary or booster motor 15. The direction of travel or movement of this endless storage and conveyor chain 11 is indicated by four arrows conveniently designated by reference characters A, B, C and D. In the region of the lower deflection roll or roller 13, cartridges or rounds 16 are either delivered to the ammunition magazine 10 or extracted from the latter. For this purpose there is provided a second endless conveyor chain 17 by means of which the cartridges or rounds 16 are delivered to an automatic firing weapon 36. This second endless conveyor chain 17 must be synchronously driven with respect to the rate of fire of the automatic firing weapon 36. However, the delivery of cartridges or rounds 16 to the automatic firing weapon 36 is known to the art and therefore need not here be further considered, particularly since details thereof beyond what is discussed in this disclosure are considered unimportant for understanding the underlying principles and concepts of the present invention.

Figure 2:
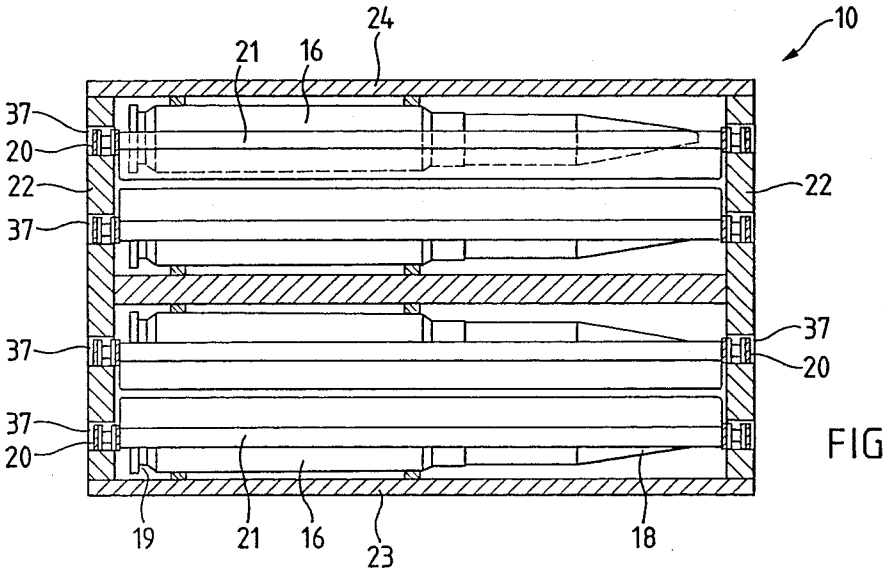
FIG. 2 shows a cross-section of the ammunition magazine of FIG. 1, taken substantially along the line II—II thereof.

Attention is now drawn to FIG. 2 where it will be observed that the endless storage and conveyor chain 11 possesses chain elements or members 20 in the region of cartridge tips 18 as well as in the region of cartridge bottom ends or bases 19. At these chain elements or members 20 there are mounted cradles or buckets 21 which serve to accommodate or receive the individual cartridges or rounds 16. The chain elements or members 20 located in the region of the cartridge tips 18 and the chain elements or members 20 located in the region of the cartridge bottom ends 19 are appropriately fastened together by means of the cradles or buckets 21 to form the entire or complete endless storage and conveyor chain 11. This endless storage and conveyor chain 11 is guided in lateral or side walls 22 of the ammunition magazine 10, the lateral or side walls 22 being fastened together by a bottom or floor plate 23 and a cover or covering 24. In each lateral or side wall 22 there are provided, according to the showing of Figure 2, four guide rails or tracks 37, since the endless storage and conveyor chain 11, as hereinbefore mentioned, is folded to form a double loop.

According to FIG. 1 a top or uppermost section or layer 40 of the endless storage and conveyor chain 11 is pulled by the auxiliary or booster motor 15 by means of the upper deflection roll or roller 14 in the direction of arrow A. This top or uppermost section or layer 40 of the endless storage and conveyor chain 11 also pulls a bottom or lowermost section or layer 41 of the endless storage and conveyor chain 11 in the direction of arrow D. Furthermore, a second uppermost section or layer 42 of the endless storage and conveyor chain 11 is pushed by the auxiliary or booster motor 15 by means of the upper deflection roll or roller 14 in the direction of arrow B. This second uppermost section or layer 42 of the endless storage and conveyor chain 11 also pushes a second lowermost section or layer 43 of the endless storage and conveyor chain 11 in the direction of arrow C. The two middle or intermediate sections or layers 42 and 43 of the endless storage and conveyor chain 11 are thus pushed in the direction of the arrows B and C, respectively, while the two outer sections or layers 40 and 41 of the double loop of the endless storage and conveyor chain 11 are pulled in the direction of the arrows A and D, respectively.

On the other hand, the lower deflection roll or roller 13 driven by the automatic firing weapon 36 pulls the middle or intermediate sections or layers 42 and 43 of the endless storage and conveyor chain 11 in the direction of arrows B and C, respectively, and pushes the two outer sections or layers 40 and 41 of the double loop of the endless storage and conveyor chain 11 in the direction of the arrows A and D, respectively. This relatively insignificant fact as such has been discussed here in particular detail because it is considered essential for understanding the underlying principles and concepts of the present invention.

Figure 3:
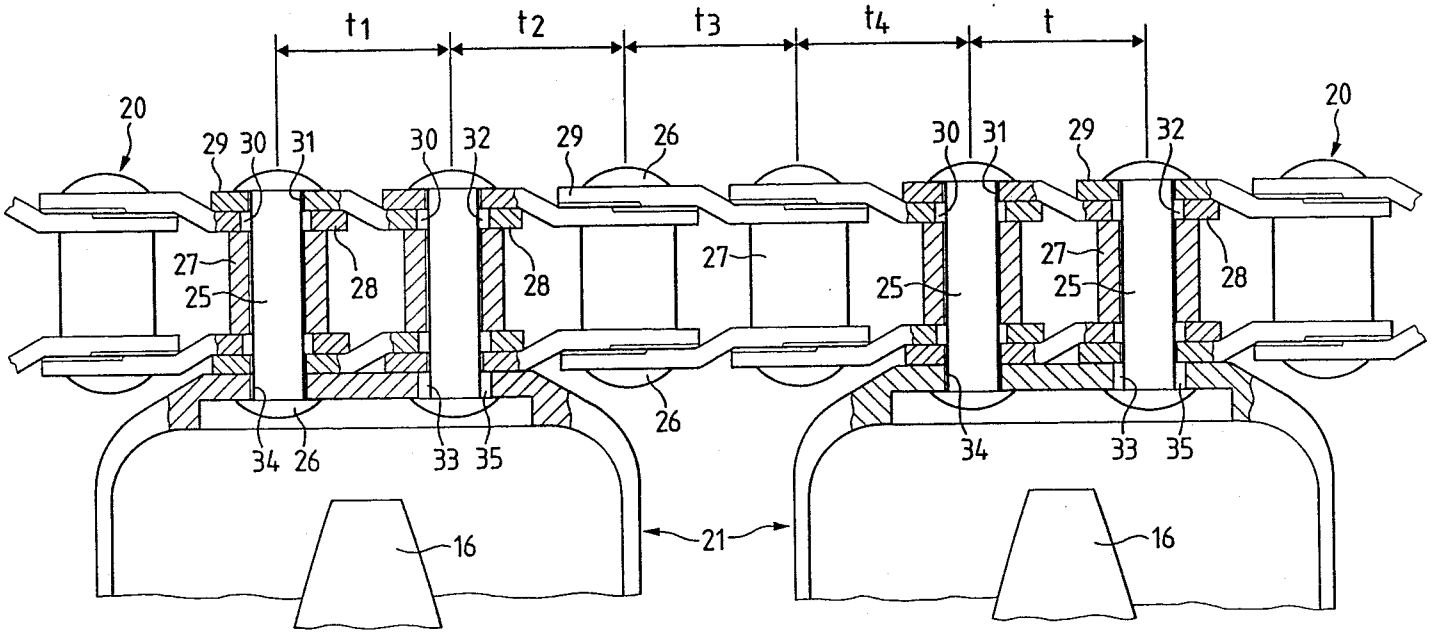
FIG. 3 is a top view partially in plan and partially in cross-section and showing a portion of the endless storage and conveyor chain constructed according to the invention.
Figure 4:
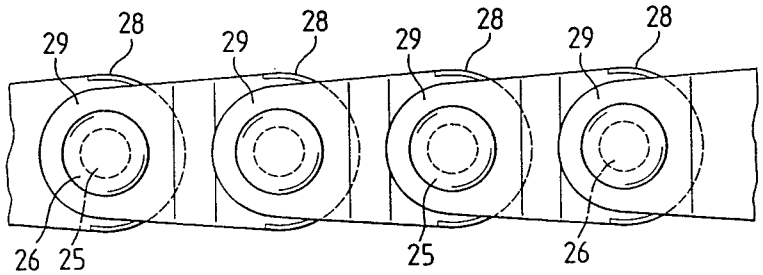
FIG. 4 shows a side view of a portion of the endless storage and conveyor chain as depicted in FIG. 3 as viewed from the top of the showing thereof.

According to the showing of FIGS. 3 and 4, conventional and commercially available chain elements or members 20 are used. Each such chain element or member 20 comprises a bolt or pin 25 which is provided at both ends thereof with respective rivet heads 26. A roll or sleeve or spacer sleeve 27 is rotatably mounted at such bolt or pin 25. At each end of such roll or sleeve 27 there are hingedly connected at the associated bolt or pin 25 an inner plate element 28 and an outer plate element 29. In accordance with the teachings of the present invention the inner plate element 28 possesses a substantially larger bore or borehole 30 than the outer plate element 29, a bore or borehole 31 of the latter being essentially only slightly larger than the diameter of the associated bolt or pin 25. By virtue of the larger bores or boreholes 30 located at each inner plate element 28, each chain element or member 20 is displaceable with respect to its immediately adjacent or neighboring chain element or member 20 by a clearance 32 provided between the larger bore or borehole 30 and the associated bolt or pin 25. The clearance 32 is selected such that the entire storage and conveyor chain 11, according to the illustration in FIG. 1, can be lengthened or shortened by four divisions or graduations.

According to FIG. 3 a cradle or bucket 21 for cartridges or rounds 16 is secured at two immediately adjacent or neighboring bolts or pins 25. This cradle or bucket 21 possesses two neighboring bores or boreholes 33 and 34, of which the one bore or borehole 34 is likewise smaller than the other bore or borehole 33, so that one of the two adjacent or neighboring bolts or pins 25 extends likewise with a clearance 35 into the bore or borehole 33 of the cradle or bucket 21. In this manner, the lengthening or shortening of the endless . storage and conveyor chain 11 is not obstructed by the cradles or buckets 21.

The mode of operation of the above-described ammunition magazine 10 containing the endless storage and conveyor chain 11, from which ammunition magazine 10 cartridges or rounds 16 are delivered to an automatic firing weapon 36, is as follows:

In the event of a firing burst or operation the second endless conveyor chain 17 is immediately accelerated to the required or appropriate velocity by the not specifically illustrated drive of the automatic firing weapon 36. This is readily possible since the weight of this second endless conveyor chain 17 is relatively small in comparison with the weight of the endless storage and conveyor chain 11. At the same moment of time the second lowermost section or layer 43 of the endless storage and conveyor chain 11 is progressively moved in the direction of arrow C in that one cartridge or round 16 after the other is successively placed into motion, the spacing between two neighboring cartridges or rounds 16 slightly increasing in each case. Subsequently, in the same manner the second uppermost section or layer 42 of the endless storage and conveyor chain 11 is moved in the direction of arrow B in that, once again, one cartridge or round 16 after the other is placed into motion. During this operation, the auxiliary or booster motor 15 has sufficient time to accelerate to its full rotational speed and thus also place into motion the remaining sections or layers 40 and 41 of the endless storage and conveyor chain 11 in the directions of the arrows A and D, respectively. By virtue of the clearances 33 and 35 provided in the endless storage and conveyor chain 11, the above-described lengthening of the endless storage and conveyor chain 11 is rendered possible. At the end of the firing burst or operation the middle or intermediate sections or layers 42 and 43 of the endless storage and conveyor chain 11 are pushed together in the direction of arrows B and C into their respective starting positions, and the two outer sections or layers 40 and 41 are again pulled apart in the direction of arrows A and D.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An endless storage and conveyor chain in an ammunition magazine, from which cartridges are delivered to an automatic firing weapon, comprising:

a cartridge infeeding device driven by said automatic firing weapon;

the endless storage and conveyor chain with the ammunition thereupon forming at least one loop in the ammunition magazine;

at least one drive wheel and at least one deflection roll;

the endless storage and conveyor chain being trained over said at least one drive wheel and said at least one deflection roll;

said at least one loop of the endless storage and conveyor chain being folded to form a double loop;

the endless storage and conveyor chain folded into said double loop having a substantially central portion;

means for drivingly coupling said substantially central portion of said endless storage and conveyor chain to said automatic firing weapon;

a booster motor drivingly connected to said at least one drive wheel;

said booster motor driving the storage and conveyor chain into said substantially central portion by means of said at least one drive wheel; and the endless storage and conveyor chain containing a plurality of individual chain elements telescopically interconnected for absorbing acceleration forces which occur at least at the beginning of a firing burst.

2. The endless storage and conveyor chain as defined in claim 1, further including:

said individual chain elements being telescopically interconnected with a predetermined clearance;

said cartridge infeeding device having a predetermined infeeding velocity; and said predetermined clearance being such that at least one cartridge can be fired until the entire endless storage and conveyor chain is accelerated by said booster motor to said predetermined infeeding velocity.

3. The endless storage and conveyor chain as defined in claim 2, wherein:

each individual chain element of said plurality of individual chain elements comprises:

a bolt having a predetermined diameter;

an inner member and an outer member;

said inner member and said outer member being provided with respective boreholes for said bolt;

said inner member and said outer member being hingedly connected at said bolt;

one of said boreholes possessing a diameter substantially larger than said predetermined diameter of said bolt; and said bolt extending with said predetermined clearance through said one borehole having said diameter substantially larger than said predetermined diameter of said bolt.

4. The endless storage and conveyor chain as defined in claim 1, further including:

the cartridges arranged at the endless storage and conveyor chain having respective cartridge tip ends and respective cartridge bottom ends;

said cartridge tip ends defining a region of cartridge tip ends;

said cartridge bottom ends defining a region of cartridge bottom ends;

said plurality of individual chain elements being located in said region of cartridge tip ends as well as in said region of cartridge bottom ends;

a plurality of individual cradle elements serving to accommodate individual cartridges; and said individual chain elements located in said region of cartridge tip ends and said individual chain elements located in said region of cartridge bottom ends being fastened together by means of said plurality of individual cradle elements.

5. The endless storage and conveyor chain as defined in claim 2, wherein:

each said individual chain element containing two first plate elements hingedly connected to a connecting element which holds the two first plate elements at a predeterminate transverse spacing from each other as viewed transversely with respect to a lengthwise direction of said endless storage and conveyor chain;

each said individual chain element further containing two second plate elements which telescopingly extend at a predeterminate transverse spacing between said two first plate elements and enclose said connecting element with said predetermined clearance;

said two first plate elements of each said individual chain element extending towards and forming respective second plate elements at a further individual chain element immediately adjacent each said individual chain element as viewed in the lengthwise direction of said endless storage and conveyor chain; and said predetermined clearance between said two second plate elements and said connecting element in each one of said plurality of individual chain elements permitting mutual movement of said individual chain elements relative to each other under the driving action of either one of said automatic firing weapon or said booster motor upon the endless storage and conveyor chain.

6. The endless storage and conveyor chain as defined in claim 3, wherein:

said inner member of said individual chain element being connected with the outer member of a further individual chain element immediately adjacent said individual chain element as viewed in a lengthwise direction of said endless storage and conveyor chain.

* * * * *